US005788389A

United States Patent [19]

de Laforcade

[11] Patent Number: 5,788,389

[45] Date of Patent: Aug. 4, 1998

[54] DISPENSER AND PACKAGE FOR A PRESSURIZED LIQUID

[75] Inventor: Vincent de Laforcade, Rambouillet, France

[73] Assignee: L'Oreal, Paris, France

[21] Appl. No.: 684,853

[22] Filed: Jul. 25, 1996

[30] Foreign Application Priority Data

Aug. 2, 1995 [FR] France ..... 95 09421

[51] Int. Cl.[6] ..... A45D 34/04

[52] U.S. Cl. ..... 401/190; 401/207

[58] Field of Search ..... 401/190, 207

[56] References Cited

U.S. PATENT DOCUMENTS

| | | | |
|---|---|---|---|
| 1,321,891 | 11/1919 | Croner | 401/207 |
| 1,589,807 | 6/1926 | Kuns | 401/207 |
| 2,481,803 | 9/1949 | Weaver | 401/207 |
| 3,128,493 | 4/1964 | Paul | 401/207 X |
| 3,184,781 | 5/1965 | Hoxie | 401/190 X |
| 3,256,549 | 6/1966 | Evesque | 401/190 |
| 4,239,407 | 12/1980 | Knight | 401/190 |

FOREIGN PATENT DOCUMENTS

| | | | |
|---|---|---|---|
| 2 092 781 | 1/1972 | France . | |
| 2581569 | 11/1986 | France | 401/190 |
| 2 713 060 | 6/1995 | France . | |
| 19 03 303 | 7/1970 | Germany . | |
| 466176 | 1/1969 | Switzerland | 401/190 |

*Primary Examiner*—Steven A. Bratlie
*Attorney, Agent, or Firm*—Oliff & Berridge, PLC

[57] ABSTRACT

A device for dispensing and packaging a substance, the device including a receptacle for storing a substance under pressure, a control valve, and a porous applicator made of sintered material or the like. The applicator has an external applicator surface designed to come into contact with the skin of the user to dispense the substance. The applicator includes a blind hole for fixing directly on the control rod. The depth of the hole is selected in such a manner as to achieve in situ injection of the substance into the applicator with the substance diffusing substantially axially towards the center of the external applicator surface.

10 Claims, 1 Drawing Sheet

DISPENSER AND PACKAGE FOR A PRESSURIZED LIQUID

The present invention relates to a device for dispensing and packaging a substance, the device includes a receptacle for storing the substance under pressure and provided with a valve having a control rod, and with a porous applicator of sintered material or the like having an external applicator surface for coming into contact with the skin of the user for the purpose of dispensing the substance.

BACKGROUND OF THE INVENTION

Document FR-A-2 713 060 in the name of the Applicant describes a device of that type. The applicator is carried by a cup of plastics material that is downwardly extended by an endpiece for engaging on the control rod, the endpiece has an internal channel for passing the substance. The substance leaves the control rod when the valve is opened and the substance is channeled by the endpiece and the cup towards the internal face of the applicator which is opposite from the external applicator surface.

The comfort of the use of such a device depends, in particular, on the sensation of coolness felt by the user on contact between the applicator and the skin. The coolness is due in part to the fact that the substance is cooled during the expansion that accompanies its discharge from the pressurized receptacle. Also, it is desirable to prevent droplets of substance running over the receptacle or onto the hands of the user in the event of prolonged use. The cup of the device described in FR-A-2 713 060 has a depression liable to collect excess liquid ejected by the control rod, and substantially radial channels provided between the internal face of the cup and the internal face of the applicator to ensure good distribution of the dispensed substance and to feed the external applicator surface uniformly. An antisplash device facing the end of the internal channel of the endpiece is implemented for the same purpose.

Although a device of the type described in FR-A-2 713 060 provides satisfaction, it is of relatively complex structure.

OBJECTS AND SUMMARY OF THE INVENTION

An object of the invention is to propose a novel device for dispensing and packaging which is of simplified structure while being just as comfortable in use as known devices.

This is achieved with an applicator that includes a central blind hole that enables the applicator to be fixed directly on the control rod. The depth of the hole is selected to achieve in situ injection of the substance into the applicator with substantially axial diffusion of the substance towards the center of the external applicator surface.

Unexpectedly, it has been observed that in spite of the absence of a substance-distributing cup on the internal face of the applicator, satisfactory or even improved comfort is obtained in use.

Preferably, the external applicator surface is aspherical, and generally convex towards the outside. The dome of the applicator is organized so that the substance diffuses through the applicator in a diffusion cone that is inscribed in a volume defined by an extreme cone whose generator line bears against the perimeter of the external applicator surface and whose apex is situated on the axis of the control rod. Because of the invention, the side surface of the applicator that extends the external applicator surface radially outwards and downwards does not receive the substance for a certain length of time after the valve has been opened. Therefore, in the event of prolonged use of the device, which causes droplets of substance to appear in the center of the external applicator surface, the side surface of the applicator is not saturated in substance and remains capable of absorbing the droplets when they leave the center of the external applicator surface under gravity. The absorption of the substance by the side surface prevents the substance running over the receptacle or the hands of the user.

Because the side surface of the applicator has the capacity to absorb the substance, it is possible to concentrate the ejection of the substance towards the center of the external applicator surface without running the risk of droplets of substance forming on the surface in the event of the prolonged opening of the valve. The absorption also prevents the substance from running over the receptacle or the hands of the user. It is also possible to take advantage of the fact that the substance ejected by the control rod reaches the external applicator surface very quickly and in a localized manner with little increase in temperature, thereby imparting an increased sensation of coolness on contact with the skin of the user.

Also, concentrating the substance in the center of the applicator allows the user to actuate the valve to test the device by holding the periphery of the applicator and without running the risk of wetting the fingers with the substance, since the periphery of the applicator remains free from any direct feed of substance for a certain length of time after the valve has been opened, as explained above.

In a particular embodiment of the invention, an annular groove is provided to further improve the channelling of the substance towards the center of the external applicator surface by delaying diffusion of the substance towards the side surface of the applicator. The presence of an annular groove in the bottom face of the applicator that is open towards the receptacle is also advantageous when the control rod is tiltable, and when the valve is a valve which opens under a sideways thrust on the control rod, since the groove makes it possible to increase the maximum angular displacement of the applicator before it comes into contact with the receptacle.

BRIEF DESCRIPTION OF THE DRAWINGS

Other characteristics and advantages of the present invention appear on detailed reading of two non-limiting embodiments of the invention and on examining the accompanying drawing, in which.

MORE DETAILED DESCRIPTION

Figure 1:
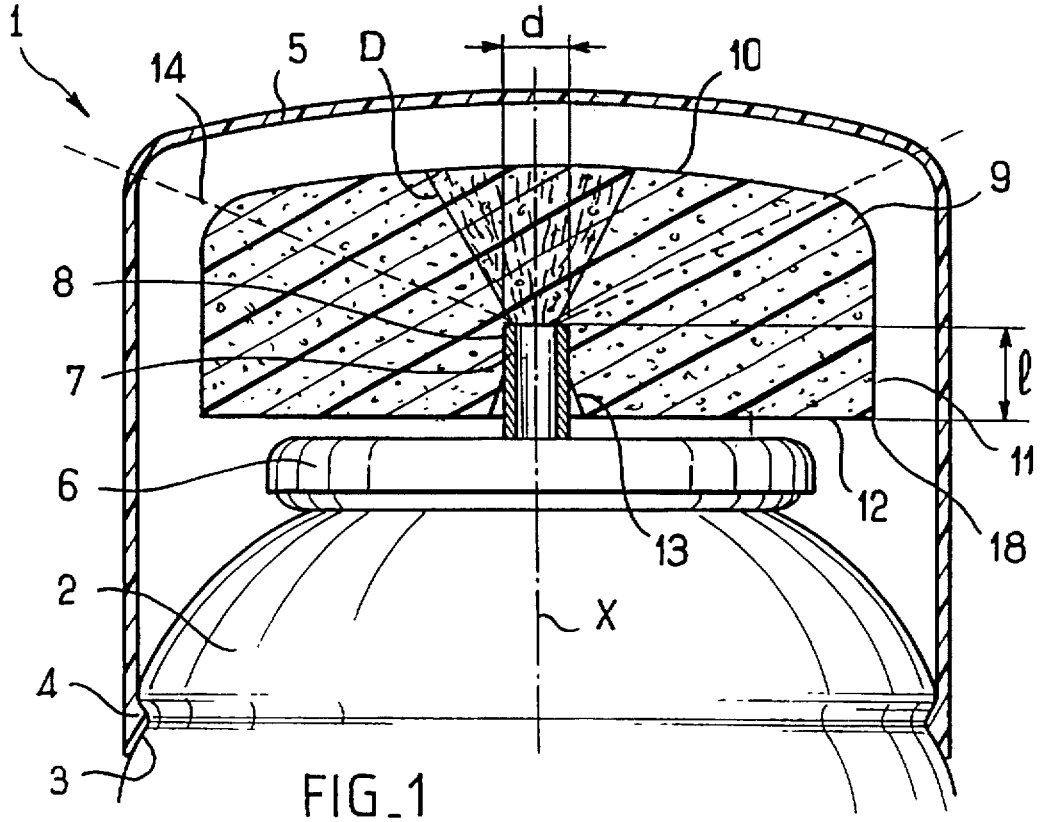
FIG. 1 is a fragmentary and diagrammatic axial section view of a dispensing and packaging device constituting a first embodiment of the invention.

FIG. 1 shows a device 1 for dispensing and packaging a liquid substance such as a deodorant, and constituting a first embodiment of the invention. The device 1 includes a conventional receptacle 2 of the aerosol can type which is circularly symmetrical about a longitudinal axis X. The receptacle 2 has a dome-shaped top end provided with an annular groove 3 for snap-fastening an annular rim 4 of a protective cap 5 that is shaped to fit on the top end of the receptacle 2 when the device is not in use. The receptacle 2 includes a conventional valve, and FIG. 1 only shows the control rod 7 and the means for fixing it to the receptacle (constituted in the embodiment descried by a cup 6 which is crimped in an opening of the receptacle 2). In the embodiment shown in FIG. 1, the valve fitted to the receptacle 2 opens by depressing the control rod 7. Naturally, without going beyond the ambit of the invention, it is possible to use a valve that opens by applying a sideways thrust on the control rod.

The control rod 7 extends along the axis X and it has an internal axial channel for passing the substance. The control rods emerging end is force-fit in a blind hole 8 of an applicator 9 made of by a porous block that is obtained by sintering microspheres of polyethylene. The applicator 9 is soft to touch, only slightly compressible and deforms very little or not at all when it contacts the skin of the user.

The top of the applicator 9 is defined by an external applicator surface 10 that is intended to come into contact with the skin of the user. The applicator is aspherical in shape and bulges slightly towards the outside. Around its circular periphery centered on the axis X, the surface 10 connects (without forming any sharp edges) to a side surface 11 that is circularly cylindrical about the axis X in the embodiment described. The bottom of the applicator 9 is defined by a plane surface 12 extending perpendicularly to the axis X, with the hole 8 opening out into the center thereof. The bottom end of the hole 8 is chamfered to define a conical inlet 13 that facilitates insertion of the control rod 7 into the hole 8 when the applicator 9 is mounted to the rod.

According to the invention, the insertion length 1 of the control rod 7 in the applicator 9, i.e. the depth of the blind hole 8 is selected that substance that is leaving the control rod 7 is injected in situ into the applicator 9 and diffuses mainly axially towards the external applicator surface 10. The distance 1 is preferably greater than or equal to half the outside diameter d of the control rod 7 and the substance diffuses in the applicator 9 in a diffusion cone D that is inscribed in a volume defined by a cone 14 that extends to the periphery of the external applicator surface 10 and that has its apex situated on the axis X in the vicinity of the top end of the control rod 7. Thus, substance ejected from the control rod diffuses mostly towards the top of the external applicator surface 10, i.e. towards its central region, and it reaches the side region of the applicator 9 only later on, after a certain amount of time has elapsed. When the device 1 is used for a short duration only, the side surface 11, therefore, remains free of substance and retains its absorption capacity in full to absorb any drops of liquid that may form on the top of the external applicator surface 10 (while the device 1 is possibly inclined relative to the vertical) and running under gravity over the external surface of the applicator 9. This prevents drops of substance running down the full height of the side wall 11 and dropping onto the receptacle or the hands of the user, thereby guaranteeing that the device 1 is comfortable to use under all circumstances.

The in situ injection of the substance into the applicator enables the substance to reach the top of the external applicator surface 10 very quickly, and thus without significant warming after it has expanded, thereby conferring a significant sensation of coolness on the user.

Figure 2:
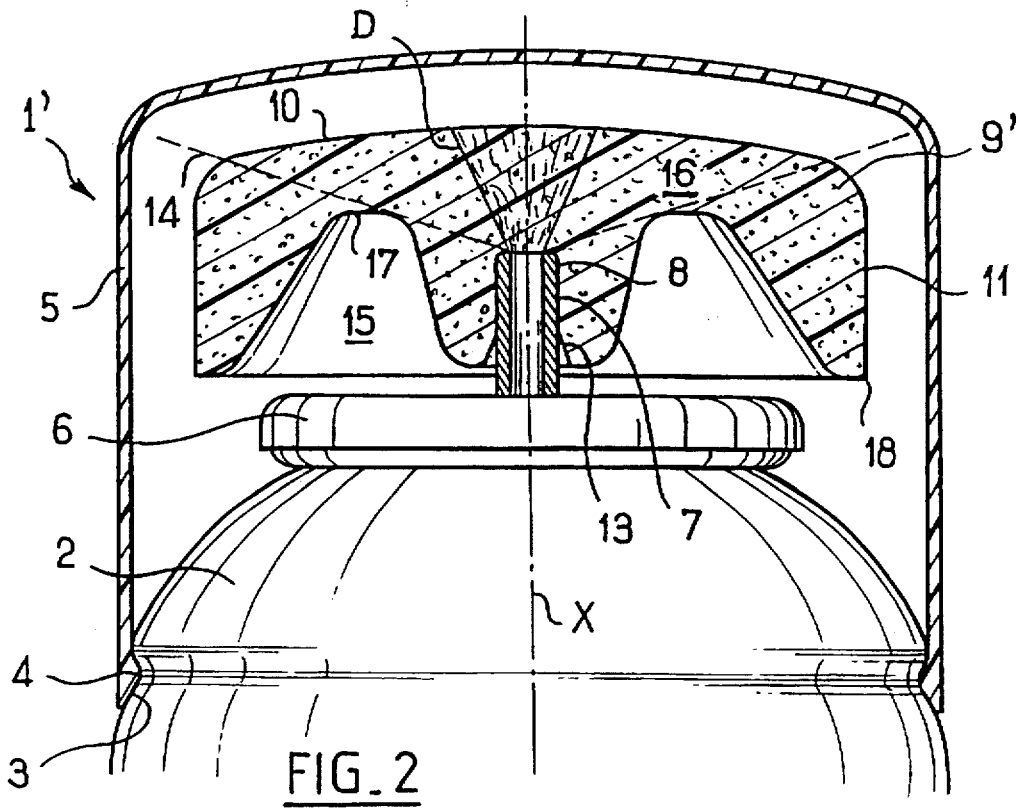
FIG. 2 is a fragmentary and diagrammatic axial section view of a dispensing and packaging device constituting a second embodiment of the invention.

FIG. 2 shows a device 1' constituting a second embodiment of the invention. The same reference symbols are used for elements that are identical to those of the preceding embodiment. The device 1' differs from the above-described device in the shape of its applicator, now referenced 9', which has an annular groove 15, and in the type of valve used, which is opened by pressing the control rod 7 sideways. The annular groove 15 has a section that flares towards the receptacle and that is flat-bottomed. The annular grove 15 enables the applicator 9' to tilt through a large angle about an axis of rotation perpendicular to the axis X to open the valve since the cup 6 can penetrate into the groove 15 when the applicator is tilted. The annular groove 15 also has an annular region 16 of reduced thickness between the bottom 17 of the groove and the external applicator surface 10, which makes it more difficult for the substance to diffuse radially outwards and also retards saturation of the side surface 11 with the substance to be retarded so as to conserve the full capacity of the side wall to absorb droplets of substance that may reach it when the device 1' is used for a long period of time.

It will be observed that in both embodiments described above, the opening of the blind hole 8 is situated substantially in the same plane as the radially outer bottom edge 18 of the applicator 9.

To use the device 1 or 1', the cap 5 is removed and the applicator 9 is passed over the region of skin where it is desired to dispense the substance. With the device 1, the applicator is pressed slightly so as to depress the control rod 7 and open the valve. With the device 1', friction on contact with the skin suffices to tilt the applicator 9' and open the valve.

Naturally, the invention is not limited to the embodiments described above and a variety of modifications and variants can be applied without going beyond the ambit of the present invention.

I claim:

1. A device for dispensing and packaging a substance, the device comprising a receptacle for storing said substance under pressure, a valve having a control rod, and an applicator made of porous material, the applicator having an external applicator surface designed to come into contact with the skin of the user for dispensing the substance, wherein said applicator includes a blind hole for fixing directly on the control rod without a carrying cup to cause the substance to be injected in situ into the applicator with the substance diffusing substantially axially towards the center of said external applicator surface.

2. A device according to claim 1, wherein the substance diffuses through the applicator in a diffusion cone inscribed within a volume defined by a cone based on the periphery of the external applicator surface and having its apex situated on the axis of the control rod in the vicinity of its top end.

3. A device according to claim 1, wherein the blind hole has a depth and wherein said depth is not less than half the outside diameter of said control rod.

4. A device according to claim 1, wherein the applicator includes an annular groove.

5. A device according to claim 4, wherein said groove is situated in the bottom portion of the applicator and is open towards the receptacle.

6. A device according to claim 1, wherein said external applicator surface has a shape that bulges slightly towards the outside.

7. A device according to claim 1, wherein said blind hole has an opening lying substantially in the same plane as the radially outer bottom of the applicator.

8. A device according to claim 1, wherein said valve is opened by applying sideways thrust to said control rod.

9. A device according to claim 1, wherein said applicator comprises a block of sintered material.

10. A device according to claim 1, wherein said receptacle is an aerosol can filled with deodorant.

* * * * *